US011317659B2

(12) United States Patent
Song

(10) Patent No.: US 11,317,659 B2
(45) Date of Patent: May 3, 2022

(54) POST-OPERATIVE BRA

(71) Applicant: MedStar Health, inc., Columbia, MD (US)

(72) Inventor: David H. Song, Washington, DC (US)

(73) Assignee: MedStar Health, Inc., Columbia, MD (US)

( * ) Notice: Subject to any disclaimer, the term of this patent is extended or adjusted under 35 U.S.C. 154(b) by 222 days.

(21) Appl. No.: 16/829,961

(22) Filed: Mar. 25, 2020

(65) Prior Publication Data

US 2021/0298367 A1 Sep. 30, 2021

(51) Int. Cl.
*A41C 3/02* (2006.01)
*A41C 3/00* (2006.01)

(52) U.S. Cl.
CPC ..... *A41C 3/0064* (2013.01); *A41C 3/0028* (2013.01); *A41C 3/02* (2013.01)

(58) Field of Classification Search
CPC ..... A41C 3/00; A41C 3/0028; A41C 3/0064; A41C 3/0058; A41C 3/02
USPC ..... 450/36, 54–57
See application file for complete search history.

(56) References Cited

U.S. PATENT DOCUMENTS 3,950,792 A 4/1976 Williams
5,429,593 A 7/1995 Malory
6,786,798 B1 * 9/2004 Gendel ..... A41C 3/0064 450/1
7,144,294 B2 12/2006 Bell et al.
8,696,403 B2 * 4/2014 Haley ..... A41C 3/0028 450/36
8,708,771 B1 * 4/2014 De Rosa ..... A41C 3/10 450/36
8,790,154 B2 7/2014 Blackwell
9,370,206 B1 * 6/2016 Ellington ..... A41C 3/144
9,578,902 B2 * 2/2017 Blackwell ..... A41C 3/0035
9,993,035 B2 * 6/2018 Roman ..... A41C 3/0064
9,993,036 B2 6/2018 Swendseid et al.
10,681,942 B2 6/2020 Thompson
2012/0122370 A1 5/2012 Health et al.
(Continued)

OTHER PUBLICATIONS

International Search Report and The Written Opinion of the International Searching Authority, PCT/US2021/023927, dated Jun. 4, 2021.

(Continued)

*Primary Examiner* — Gloria M Hale
(74) *Attorney, Agent, or Firm* — Duane Morris LLP

(57) ABSTRACT

A bra is disclosed comprising a body portion and left and right adjustable shoulder straps. The body portion comprises a back panel, left and right front panels, an adjustable torso strap, and a releasable front closure. The left and right front panels comprise cups having an interior mesh lining over at least a portion of each cup. The mesh lining forms a pocket with each cup and has a coating comprising an antibacterial, antimicrobial agent. The adjustable torso strap comprises a back torso strap, left and right front torso straps, and left and right side torso straps. The left and right side torso straps have end portions that are removably attachable to left and right front torso straps. When attached to the left and right front torso straps, the left and right side torso straps and left and right front panels define left and right drainage ports.

20 Claims, 7 Drawing Sheets

(56) References Cited

U.S. PATENT DOCUMENTS

| | | | | |
|---|---|---|---|---|
| 2014/0031775 | A1* | 1/2014 | Criss | A61F 5/4408 604/355 |
| 2015/0141939 | A1* | 5/2015 | Roman | A41C 3/0064 604/308 |
| 2016/0151211 | A1 | 6/2016 | Biddlestone | |

OTHER PUBLICATIONS https://www.careandwear.com/collections/post-surgical-recovery-bras/products/post-surgical-recovery-bra.
Maurice Nahabedian, MD, "Overview-of-breast-reconstruction," https://www.uptodate.com/contents/overview-of-breast-reconstruction?topicRef=14981&source=see_link#H44799266.
https://erassociety.org/.
Laura H. Rosenberger et al., "The Surgical Care Improvement Project and Prevention of Post-Operative Infection, Including Surgical Site Infection," Jun. 2011; 12(3): 163-168. doi: 10.1089/sur.2010.083 PMCID: PMC4702424.
Jean Campbell, MS, "Post-Breast Surgery Boutiques," https://www.verywellhealth.com/post-breast-surgery-boutique-4043635, Jul. 31, 1999.
"Elizabeth pink surgical bra with pockets," https://mastheadpink.com/product/elizabeth-pink-surgical-bra-pockets/.
"Time of Permanence of Dressing Following Breast Reconstruction," https://www.clinicaltrials.gov/ct2/show/NCT01148823?term=NCT01148823&rank=1.
"Mastectomy Kit," Medebra, https://medebra.com/medebra-mastectomy/.
AP Polednak, "Bilateral synchronous breast cancer: a population-based study of characteristics, method of detection, and survival," Surgery. Apr. 2003;133(4):383-9.https://www.ncbi.nlm.nih.gov/pubmed/12717355.
Min Yi, et al. "Predictors of contralateral breast cancer in patients with unilateral breast cancer undergoing contralateral prophylactic mastectomy." Cancer vol. 115,5 (2009): 962-71 doi:10.1002/cncr.24129.
"Cancer Stat Facts: Female Breast Cancer," https://seer.cancer.gov/statfacts/html/breast.html.
Claudia A. Steiner, M.D., et al., "Trends in Bilateral and Unilateral Mastectomies in Hospital Inpatient and Ambulatory Settings, 2005-2013," https://www.hcup-us.ahrq.gov/reports/statbriefs/sb201-Mastectomies-Inpatient-Outpatient.jsp.
"Amoena USA," https://www.amoena.com/us-en/?gclid=CjwKCAjwo_HdBRBjEiwAiPPXpLtJY2GnsnBvElhUo2hdNPY7bvVmH3Z8s4FXi6DShyn6R5_KsehcChoCygcQAvD_BwE.
"Carefix," Tytex, https://tytex.com/products/post-surgery/post-surgical-bras/post-op-bras/lisa.
https://itsmysecret.org/.
https://thebrobe.com/.
https://thebrobe.com/products/post-surgical-drain-belt.
"S P+2 Surgery Drain Bulb System. Two Pockets to Hold 2 Drain Bulbs, Sugested for a Single Mastecomey," Shower Pockets Mastectomy, https://www.amazon.com.
"TRS Post Surgical Mastectomy Drain Pouch—Breast Cancer Supplies Bulb Shower Belt," TRS The Recovery Shirt by Heal In Comfort, https://www.amazon.com.
"Breast prostheses," https://www.medicare.gov/coverage/breast-prostheses.
C. Temple-Oberle, et al. "Consensus Review of Optimal Perioperative Care in Breast Reconstruction". Plastic and Reconstructive Surgery, vol. 139, No. 5, May 2017, pp. 1056e-1071e. doi: 10.1097/PRS.0000000000003242.
https://mastheadpink.com/bras/.
https://www.cardinalhealth.com/en/product-solutions/medical/patient-care/surgi-bra-and-surgi-vest-breast-supports.html.
"Care+Wear x Dr. Song Recovery Bra—Sales Update" (Redacted), Jan. 16, 2019.

* cited by examiner

POST-OPERATIVE BRA

BACKGROUND

Mastectomy and lumpectomy patients must often wear bras during their post-operative recovery process to support the patient's wound. Additionally, reconstructive surgery typically takes place during or soon after the mastectomy or lumpectomy, and bras help to support and protect reconstruction. However, mastectomy and lumpectomy patients encounter a significant amount of discomfort post-surgery because current bras do not accommodate their post-operative needs. For instance, mastectomy and lumpectomy patients require a drain post-surgery to prevent fluid buildup in the breast, and the drain placement varies from patient to patient, but current bras do not address this issue. Covering the drain with portions of a bra cause the patient significant discomfort and may interfere with the drain's proper functioning. Additionally, a paramount concern for mastectomy and lumpectomy patients post-surgery is preventing infection at the incision site, and current bras fail to address this.

SUMMARY

According to an aspect of the present disclosure, a bra is provided. The bra comprises a body portion, a left adjustable shoulder strap, and a right adjustable shoulder strap. The body portion comprises a back panel, a left front panel, a right front panel, an adjustable torso strap, and a releasable front closure. The left adjustable shoulder strap extends from the back panel to the left front panel. The right adjustable shoulder strap extends from the back panel to the right front panel. The releasable front closure is configured to join the left and right front panels and the left and right front torso straps.

The left front panel is formed from a compressive material and comprises a left cup having an interior mesh lining over at least a portion of the left cup. The mesh lining forms a pocket with the compressive material of the left cup and has a coating comprising an antibacterial, antimicrobial agent. The right panel is formed from a compressive material and comprises a right cup having an interior mesh lining over at least a portion of the right cup. The mesh lining forms a pocket with the compressive material of the right cup and has a coating comprising the antibacterial, antimicrobial agent.

The adjustable torso strap has at least portions formed from compressive material and comprises a back torso strap, a left front torso strap, a right front torso strap, a left side torso strap, and a right side torso strap. The back torso strap extends along the bottom of the back panel. The left front torso strap extends along the bottom of the left front panel and includes a hook/loop exterior surface extending laterally from proximate a medial end along at least a portion of the left front torso strap. The right front torso strap extends along the bottom of the right front panel and includes a hook/loop exterior surface extending laterally from proximate a medial end along at least a portion of the right front torso strap. The left side torso strap extends from the back torso strap and has an end portion removably attachable to the left front torso strap via a loop/hook interior surface of the end portion. When attached to the left front torso strap, the left side torso strap and the bottom edge of the left front panel define a left drainage port. The right side torso strap extends from the back torso strap and has an end portion removably attachable to the right front torso strap via a loop/hook interior surface of the end portion. When attached to the right front torso strap, the right side torso strap and the bottom edge of the right front panel define a right drainage port.

In some embodiments, the pocket of the left cup has an opening proximate a lateral end of the left cup, and the pocket of the right cup has an opening proximate a lateral end of the right cup. In some embodiments, the respective openings are sized and shaped to accommodate a surgical dressing, a soft, padded insert, a cooling pack, or a prosthetic. In some embodiments, the antibacterial, antimicrobial agent is triclosan. In some embodiments, the releasable front closure is one or more of a hook and eye fastener, a zipper, a hook and loop fastener, a snap closure, a magnetic closure, and one or more buttons. In some embodiments, the left adjustable shoulder strap and the right adjustable shoulder strap couple the back panel to the left and right front panels, respectively, via one or more of a hook and eye fastener, a zipper, a hook and loop fastener, a snap closure, a magnetic closure, and one or more buttons. In some embodiments, the body portion, the right adjustable shoulder strap, and the left adjustable shoulder strap each comprise respective interior surfaces coated with the antibacterial, antimicrobial agent. In some embodiments, the right drainage port has a height between 2 cm and 4 cm and a width between 2 cm and 4 cm, and the left drainage port has a height between 2 cm and 4 cm and a width between 2 cm and 4 cm.

According to another aspect of the present disclosure, a bra is provided. The bra comprises a body portion, a left adjustable shoulder strap, and a right adjustable shoulder strap. The body portion comprises a back panel, a left front panel, a right front panel, a torso strap, and a releasable front closure. The left adjustable shoulder strap extends from the back panel to the left front panel. The right adjustable shoulder strap extends from the back panel to the right front panel. The releasable front closure is configured to join the left and right front panels.

The left front panel is formed from a compressive material and comprises a left cup having an interior mesh lining over at least a portion of the left cup. The mesh lining forms a pocket with the compressive material of the left cup and has a coating comprising an antibacterial, antimicrobial agent. The right front panel is formed from a compressive material and comprises a right cup having an interior mesh lining over at least a portion of the right cup. The mesh lining forms a pocket with the compressive material of the right cup and has a coating comprising the antibacterial, antimicrobial agent.

The torso strap extends around the circumference of the lower end of the body portion and comprises a scalloped left strap portion and a scalloped right strap portion. The scalloped left strap portion comprises a left-side plurality of scalloped edges and extends along at least a portion of the bottom of the left front panel. The scalloped right strap portion comprises a right-side plurality of scalloped edges and extends along at least a portion of the bottom of the right front panel. The left-side plurality of scalloped edges and the right-side plurality of scalloped edges form a left-side and right-side plurality of drainage ports, respectively.

In some embodiments, the pocket of the left cup has an opening proximate a lateral end of the left cup, and the pocket of the right cup has an opening proximate a lateral end of the right cup. In some embodiments, the respective openings are sized and shaped to accommodate a surgical dressing, a soft, padded insert, a cooling pack, or a prosthetic. In some embodiments, the antibacterial, antimicrobial agent is triclosan. In some embodiments, the releasable front closure is one or more of a hook and eye fastener, a zipper, a hook and loop fastener, a snap closure, a magnetic closure, and one or more buttons. In some embodiments, the left adjustable shoulder strap and the right adjustable shoulder strap couple the back panel to the left and right front panels, respectively, via one or more of a hook and eye fastener, a zipper, a hook and loop fastener, a snap closure, a magnetic closure, and one or more buttons. In some embodiments, the torso strap is an elastic material. In some embodiments, each drainage port of the left-side and right-side plurality of drainage ports has a height between 2 cm and 4 cm and a width between 2 cm and 4 cm. In some embodiments, the scalloped left strap portion extends laterally from the center of the left cup to the center of the back panel, and the scalloped right strap portion extends laterally from the center of the right cup to the center of the back panel. In some embodiments, the body portion, the left adjustable shoulder strap, and the right adjustable shoulder strap each comprise respective interior surfaces and those respective interior surfaces are coated with the antibacterial, antimicrobial agent. In some embodiments, the torso strap further comprises a medial left strap portion that extends along at least a portion of the bottom of the left front panel and is removably attachable to the scalloped left strap portion. In some embodiments, the torso strap further comprises a medial right strap portion that extends along at least a portion of the bottom of the right front panel and is removably attachable to said scalloped right strap portion. In some embodiments, the medial left strap portion and the scalloped left strap portion are removably attachable to one another by a first hook and loop fastener, and the medial right strap portion and the scalloped right strap portion are removably attachable to one another by a second hook and loop fastener.

BRIEF DESCRIPTION OF THE DRAWINGS

The following will be apparent from elements of the figures, which are provided for illustrative purposes.

Figure 1A:
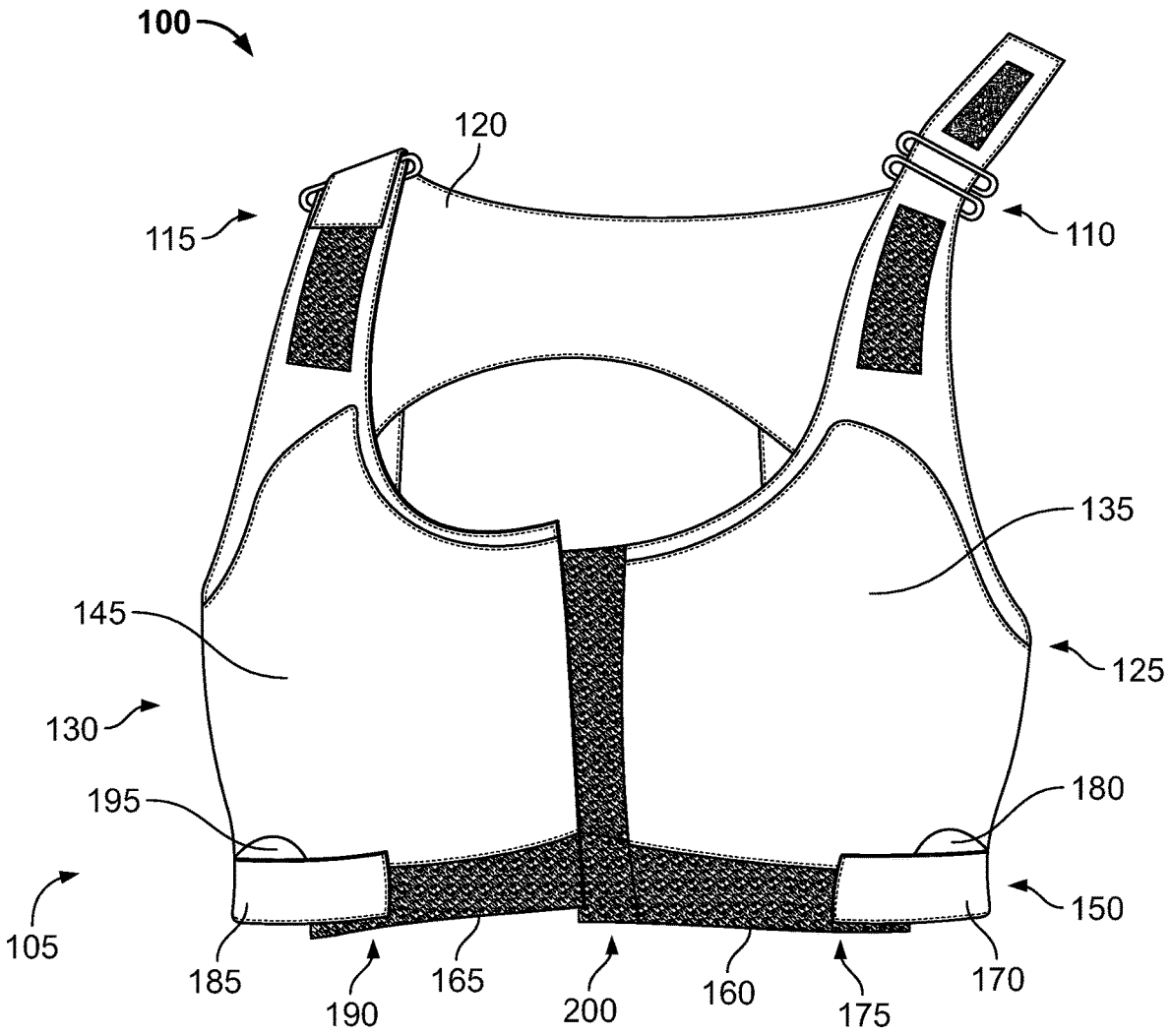
FIG. 1A is a schematic front view of a bra in accordance with some embodiments of the present disclosure.

The present application discloses illustrative (i.e., example) embodiments. The claimed inventions are not limited to the illustrative embodiments. Therefore, many implementations of the claims will be different than the illustrative embodiments. Various modifications can be made to the claimed inventions without departing from the spirit and scope of the disclosure. The claims are intended to cover implementations with such modifications.

DETAILED DESCRIPTION

For the purposes of promoting an understanding of the principles of the disclosure, reference will now be made to a number of illustrative embodiments in the drawings and specific language will be used to describe the same.

Mastectomy and lumpectomy patients are in need of a post-operative bra that accommodates varied drain placement on patients with varied ribcage and bust sizes. Additionally, there is a strong need for a bra that aids in preventing infection and promoting proper wound healing at the incision site. An example of such a post-operative bra is described herein.

Figure 1B:
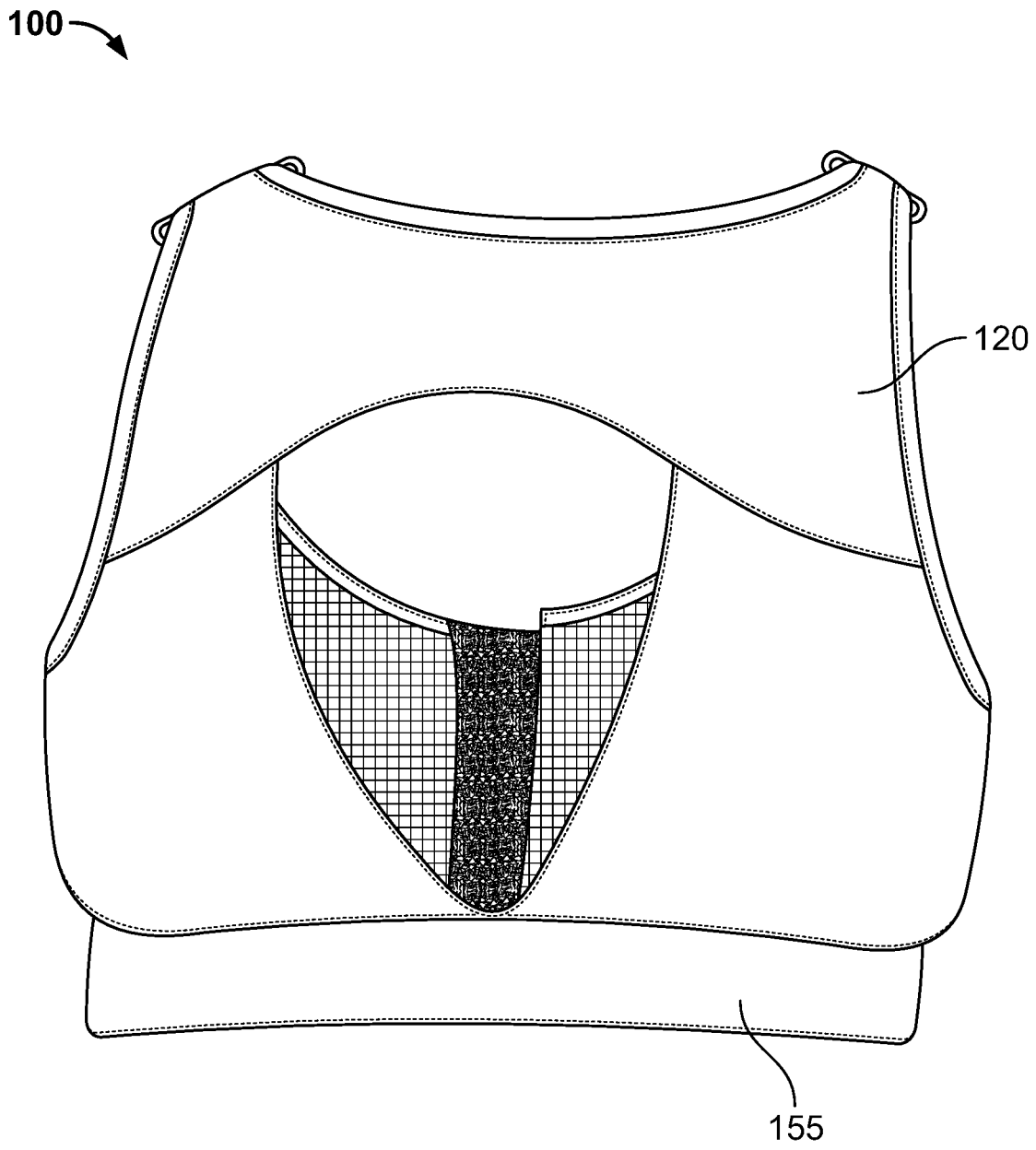
FIG. 1B is a schematic rear view of a bra in accordance with some embodiments of the present disclosure.

FIG. 1A is a schematic front view of a bra 100 in accordance with some embodiments of the present disclosure, and FIG. 1B is a schematic rear view of bra 100. Bra 100 comprises a body portion 105, as well as a left adjustable shoulder strap 110 and a right adjustable shoulder strap 115.

Body portion 105 comprises a back panel 120, illustrated in FIG. 1B. While FIG. 1B shows back panel 120 having a keyhole shape, back panel 120 is not limited to this embodiment. Back panel 120 may have a variety of shapes including but not limited to: racerback, square back, v-back, and u-back shapes.

Figure 2:
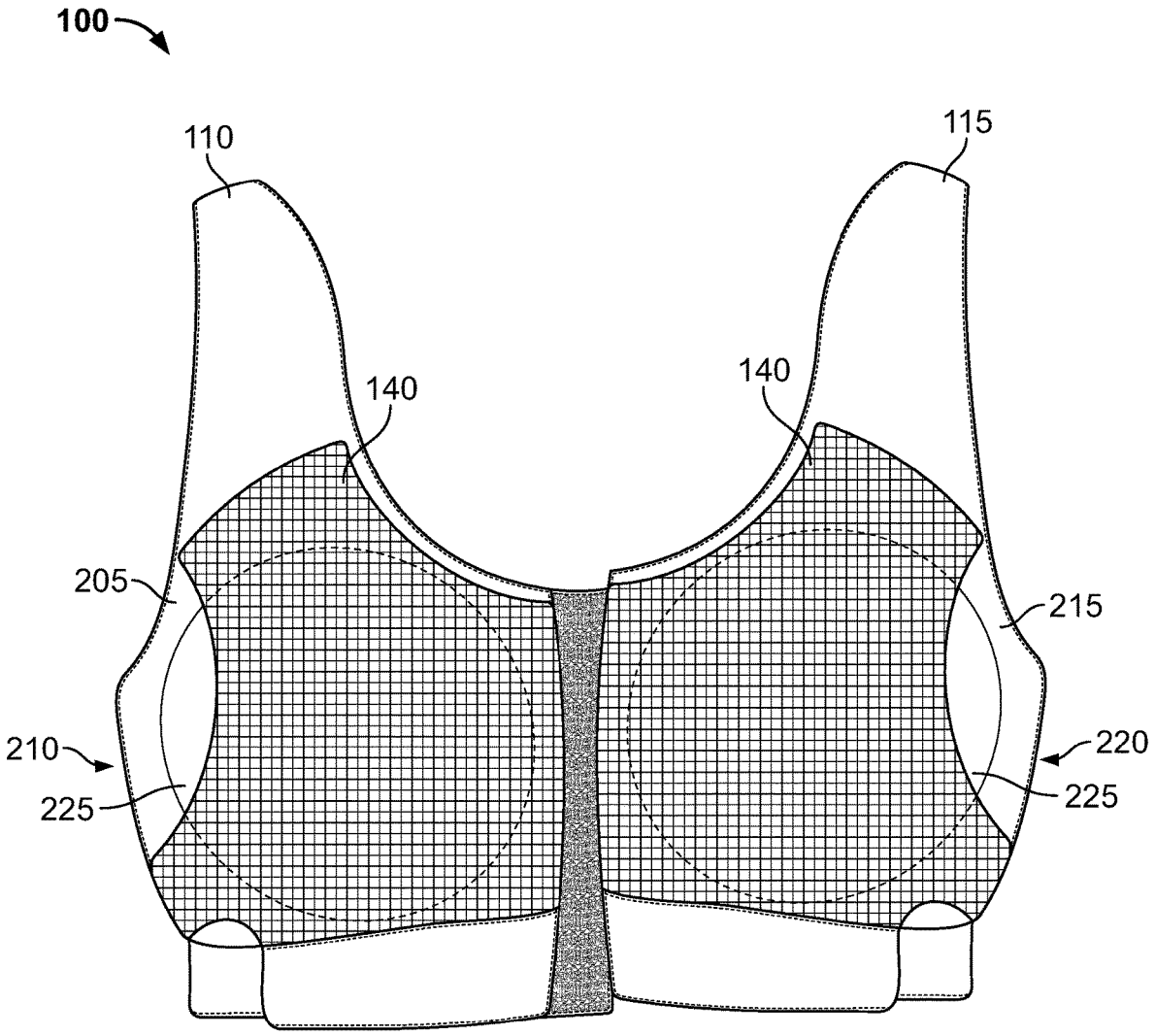
FIG. 2 is a schematic showing the interior of a front portion of a bra in accordance with some embodiments of the present disclosure.

Body portion 105 further comprises a left front panel 125 and a right front panel 130. Left front panel 125 and right front panel 130 may be formed from a compressive material to aid in user comfort. Left front panel 125 comprises a left cup 135, which may have an interior mesh lining 140 over at least a portion of the cup 135 (as illustrated in FIG. 2). Interior mesh lining 140 may be a soft, mesh material, which provides breathability and additional comfort for mastectomy and lumpectomy patients that have undergone nipple reconstruction. Right front panel 130 comprises a right cup 145, which may also have an interior mesh lining 140 over at least a portion of the cup 145.

Body portion 105 further comprises an adjustable torso strap 150, which may have at least portions formed from compressive material to promote the comfort and adjustability of torso strap 150, and thus, bra 100. Adjustable torso strap 150 comprises a back torso strap 155 that extends along the bottom of back panel 120. Adjustable torso strap 150 further comprises a left front torso strap 160 that extends along the bottom of left front panel 125. Left front torso strap 160 may include a hook or loop exterior surface that extends laterally from proximate a medial end along at least a portion of left front torso strap 160. Adjustable torso strap 150 further comprises a right front torso strap 165 that extends along the bottom of right front panel 130. Right front torso strap 165 may include a hook or loop exterior surface that extends laterally from proximate a medial end along at least a portion of the right front torso strap 165.

Adjustable torso strap 150 further comprises a left side torso strap 170 that extends from back torso strap 155. Left side torso strap 170 may have an end portion 175 that is removably attachable to left front torso strap 160 via a loop or hook interior surface of end portion 175, which may attach to the hook or loop exterior surface of left front torso strap 160. This enables a user to adjust the circumference and cup size of bra 100, which allows bra 100 to accommodate patients with a variety of rib cage and cup sizes. When attached to left front torso strap 160, left side torso strap 170 and the bottom edge of left front panel 125 define a left drainage port 180. A user may also adjust the size and location of left drainage port 180 by attaching end portion 175 to different locations along the exterior surface of left front torso strap 160. This allows bra 100 to accommodate varied drain placement, which is specific to each patient. In some embodiments, left drainage port 180 may have a height between 2 cm and 4 cm and a width between 2 cm and 4 cm.

The drainage port must be large enough to accommodate a drain; however, a drainage port with a height any greater than 4 cm may cause the bra to ride up into a user's armpit, causing the user discomfort.

Adjustable torso strap 150 further comprises a right side torso strap 185 that extends from back torso strap 155. Right side torso strap 185 may have an end portion 190 that is removably attachable to right front torso strap 165 via a loop or hook interior surface of the end portion 190, which may attach to the hook or loop exterior surface of right front torso strap 165. This enables a user to adjust the circumference and cup size of bra 100. When attached to right front torso strap 165, right side torso strap 185 and the bottom edge of right front panel 130 define a right drainage port 195. A user may also adjust the size and location of right drainage port 195 by attaching the end portion 190 to different locations along the exterior surface of right front torso strap 165. In some embodiments, right drainage port 195 may have a height between 2 cm and 4 cm and a width between 2 cm and 4 cm.

Body portion 105 further comprises a releasable front closure 200 configured to join left front panel 125 and right front panel 130, as well as left front torso strap 160 and right front torso strap 165. Releasable front closure 200 promotes ease of access for patients. Mastectomy and lumpectomy patients often have limited range of motion in their arms post-surgery until their incisions have healed. Releasable front closure 200 addresses this issue by allowing users to close bra 100 in the front, as opposed to having to extend their arms to close it in the back, which would generally cause mastectomy and lumpectomy patients pain post-surgery. FIG. 1A shows releasable front closure 200 as comprising a hook and loop fastener, but releasable front closure 200 is not limited to this embodiment. In some embodiments, releasable front closure 200 may be one or more of a hook and eye fastener, a zipper, a hook and loop fastener, a snap closure, a magnetic closure, and one or more buttons.

Left adjustable shoulder strap 110 extends from back panel 120 to left front panel 125. Right adjustable shoulder strap 115 extends from back panel 120 to right front panel 130. In some embodiments, left adjustable shoulder strap 110 and right adjustable shoulder strap 115 couple back panel 120 to left front panel 125 and right front panel 130, respectively, via one or more of a hook and eye fastener, a zipper, a hook and loop fastener, a snap closure, a magnetic closure, and one or more buttons. The aforementioned fastener means may enable easy adjustment of the length of each strap 110, 115 and may enable the user to easily remove or put on bra 100 without requiring much range of motion in the user's arms. FIG. 1A shows right adjustable shoulder strap 115 coupling back panel 120 to right front panel 130 via a hook and loop fastener. The hook and loop fastener configuration is shown in more detail on portions of left adjustable shoulder strap 110.

FIG. 2 is a schematic showing the interior of the front portion of bra 100. Interior mesh lining 140 may form a left pocket 205 with the compressive material of the left cup 135. Left pocket 205 may have an opening 210 proximate a lateral end of left cup 135. Interior mesh lining 140 may also form a right pocket 215 with the compressive material of right cup 145. Right pocket 215 may have an opening 220 proximate a lateral end of right cup 145. Openings 210, 220 may be sized and shaped to accommodate an insert 225, such as a surgical dressing, a soft, padded insert, a cooling pack, or a prosthetic. In some embodiments, soft, padded inserts help to shape, mold, and protect reconstructed breasts after surgery. In some embodiments, cooling packs may be used to combat swelling post-surgery. In some embodiments, padded inserts or prosthetics may assist in promoting an outward appearance of breast symmetry.

Interior mesh lining 140 may have a coating comprising an antibacterial, antimicrobial agent. In some embodiments, the antibacterial, antimicrobial agent may be triclosan. Coating interior mesh lining 140 with an antibacterial, antimicrobial agent aids in preventing post-surgical complications such as infection at the incision site and promotes proper wound healing. In some embodiments, body portion 105, left adjustable shoulder strap 110, and right adjustable shoulder strap 115 each comprise respective interior surfaces coated with the antibacterial, antimicrobial agent.

Figure 3A:
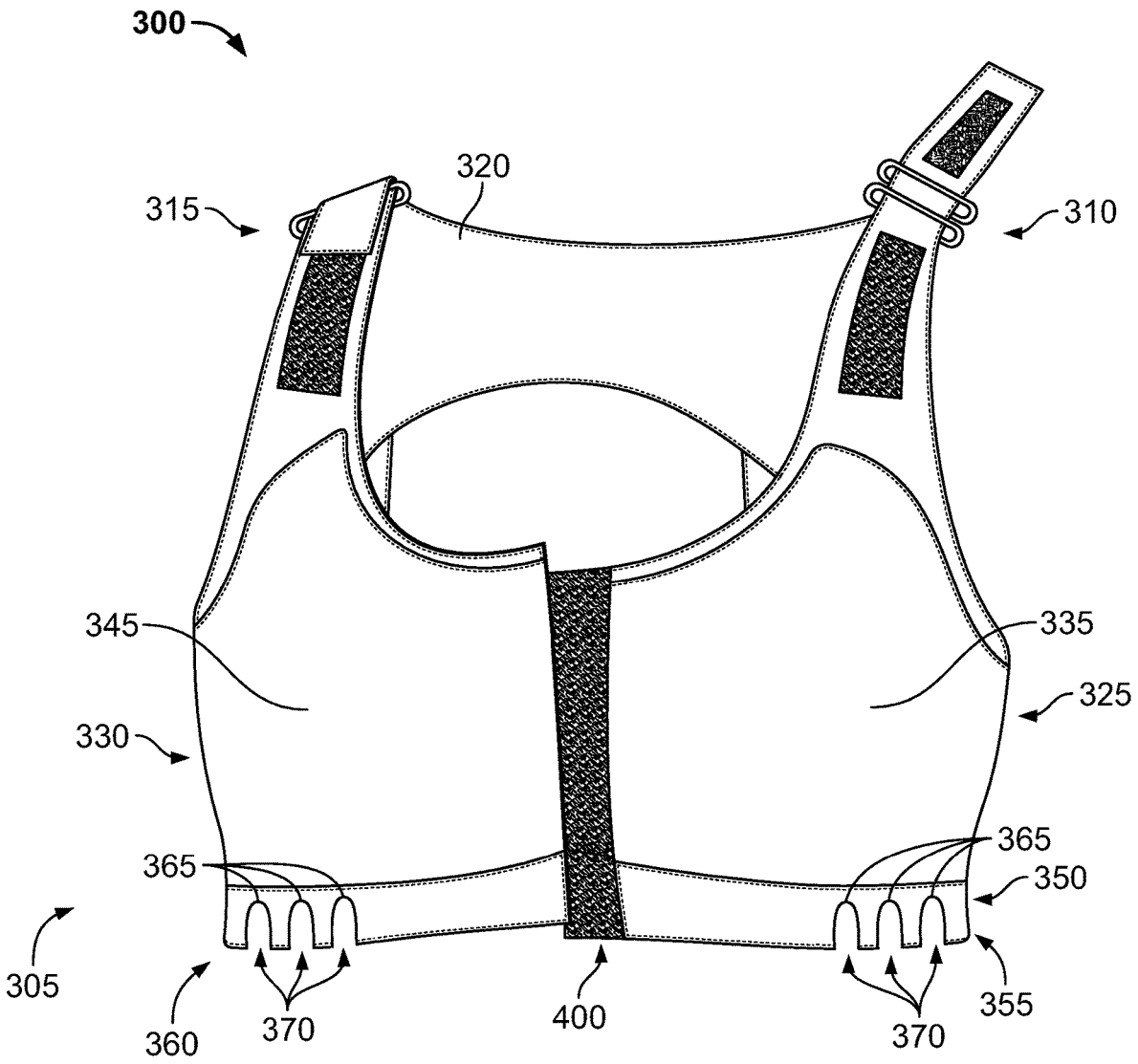
FIG. 3A is a schematic front view of a bra in accordance with some embodiments of the present disclosure.
Figure 3B:
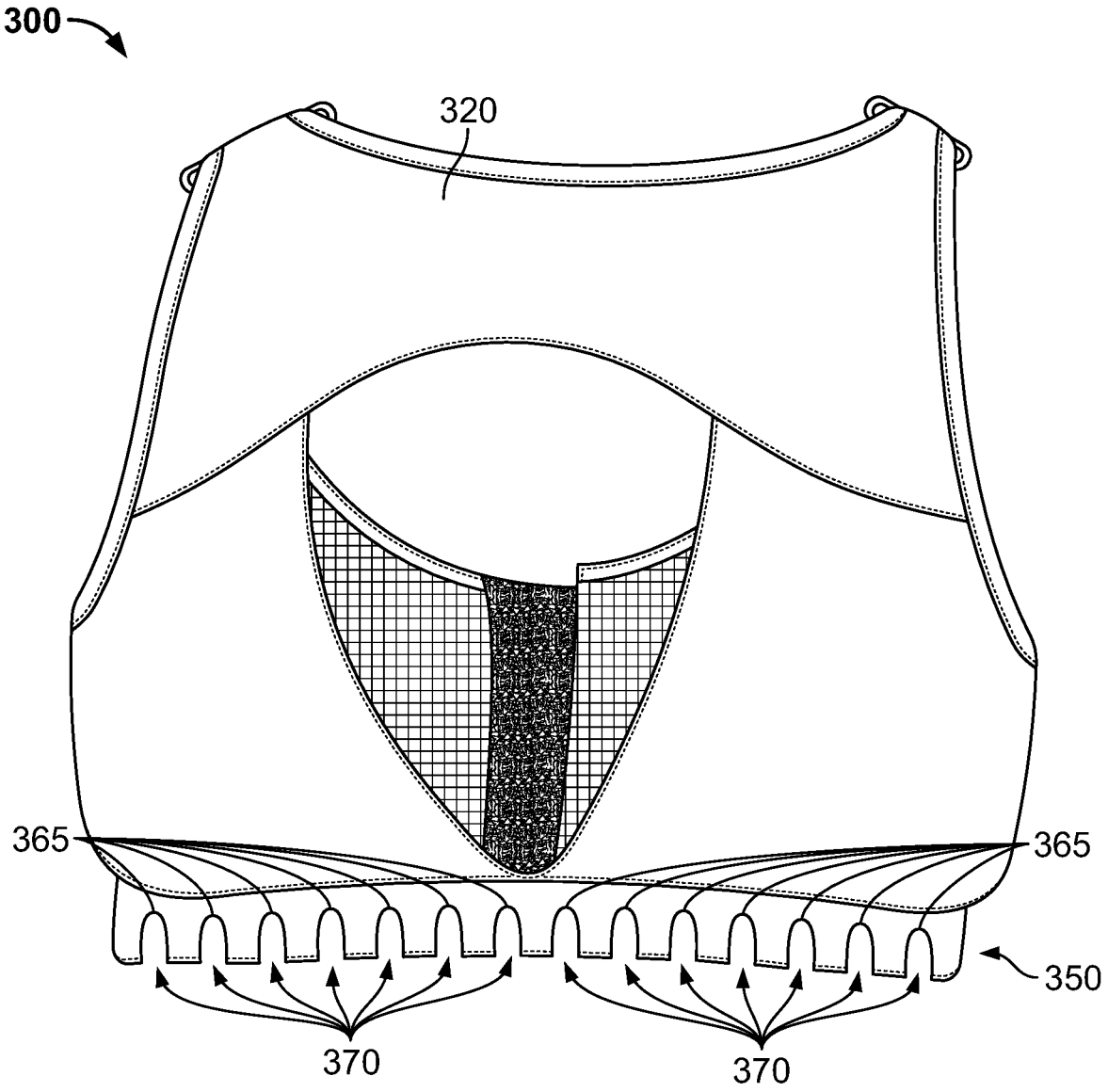
FIG. 3B is a schematic rear view of a bra in accordance with some embodiments of the present disclosure.

FIG. 3A is a schematic front view of a bra 300 in accordance with some embodiments of the present disclosure, and FIG. 3B is a schematic rear view of bra 300. Bra 300 comprises a body portion 305, as well as a left adjustable shoulder strap 310 and a right adjustable shoulder strap 315.

Body portion 305 comprises a back panel 320, illustrated in FIG. 3B. While FIG. 3B shows back panel 320 having a keyhole shape, back panel 320 may have a variety of shapes, including but not limited to those described above with respect to back panel 120.

Figure 4:
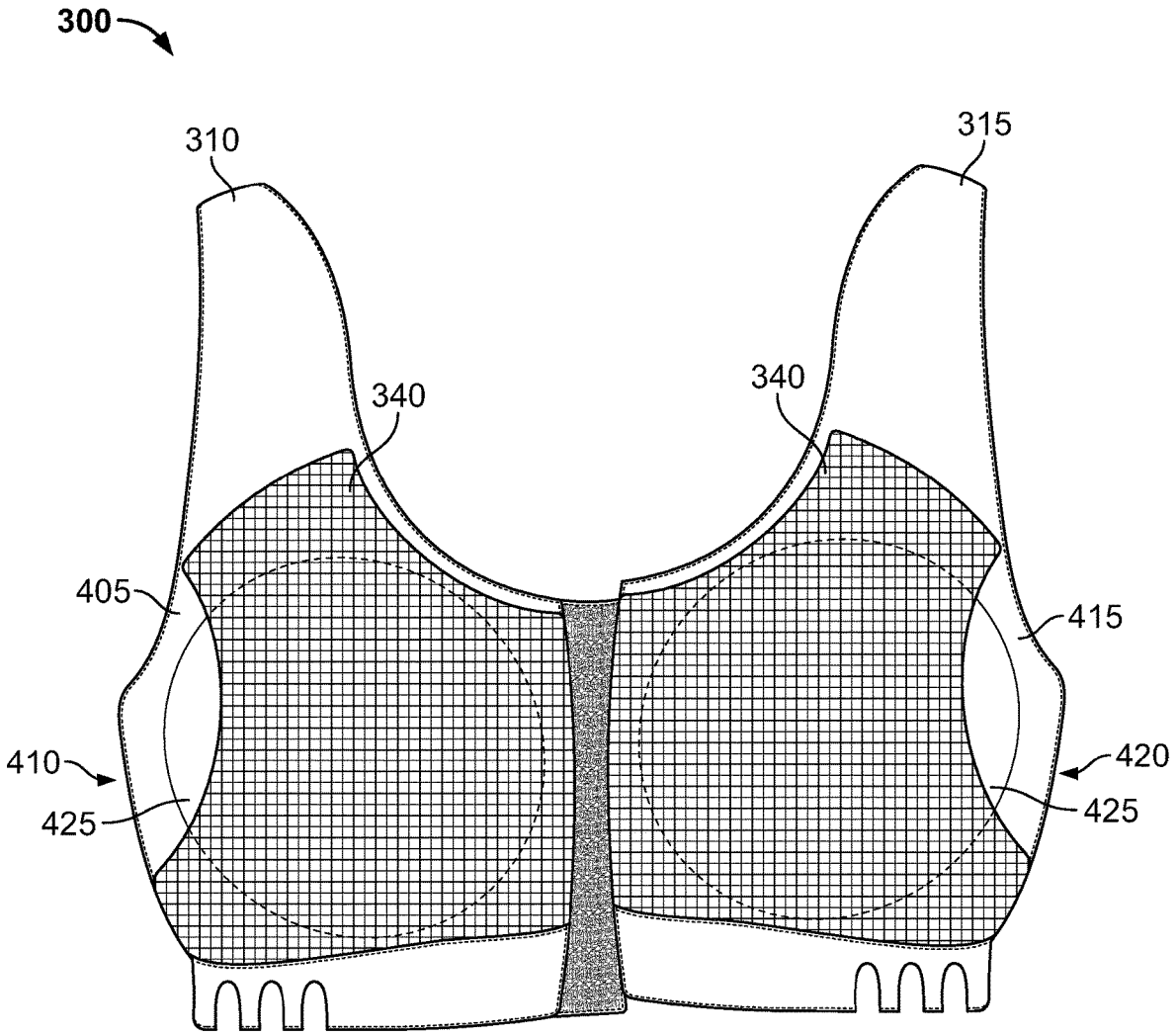
FIG. 4 is a schematic showing the interior of a front portion of a bra in accordance with some embodiments of the present disclosure.

Body portion 305 further comprises a left front panel 325 and a right front panel 330. Left front panel 325 and right front panel 330 may be formed of a compressive material. Left front panel 325 comprises a left cup 335, which may have an interior mesh lining 340 over at least a portion of the cup 335 (as illustrated in FIG. 4). Right front panel 330 comprises a right cup 345, which may also have an interior mesh lining 340 over at least a portion of the cup 345. Interior mesh lining 340 may be a soft, mesh material described above with respect to interior mesh lining 140.

Body portion 305 further comprises a torso strap 350 that extends around the circumference of the lower end of body portion 305. In some embodiments, torso strap 350 may be an elastic material to enable the torso strap 350 to stretch and promote the comfort of the user. Torso strap 350 comprises a scalloped left strap portion 355 and a scalloped right strap portion 360. Scalloped left strap portion 355 comprises a left-side plurality of scalloped edges 365 and extends along at least a portion of the bottom of left front panel 325. Scalloped right strap portion 360 comprises a right-side plurality of scalloped edges 365 and extends along at least a portion of the bottom of right front panel 330. The left-side and right-side plurality of scalloped edges 365 form a left-side and right-side plurality of drainage ports 370, respectively. The left-side and right-side plurality of drainage ports 370 allow bra 300 to accommodate a plurality of varied drain placements, which are specific to each patient. In some embodiments, each drainage port of the left-side and right-side plurality of drainage ports may have a height between 2 cm and 4 cm and a width between 2 cm and 4 cm. As illustrated in FIGS. 3A and 3B, in some embodiments, scalloped left strap portion 355 may extend laterally from the center of left cup 335 to the center of back panel 320, and scalloped right strap portion 360 may extend laterally from the center of right cup 345 to the center of back panel 320.

Body portion 305 further comprises a releasable front closure 400 configured to join left front panel 325 and right front panel 330. FIG. 3A shows releasable front closure 400 as a hook and loop fastener, but front closure 400 is not limited to this embodiment. In some embodiments, releasable front closure 400 may be one or more of a hook and eye fastener, a zipper, a hook and loop fastener, a snap closure, a magnetic closure, and one or more buttons.

Left adjustable shoulder strap 310 extends from back panel 320 to left front panel 325. Right adjustable shoulder strap 315 extends from back panel 320 to right front panel 330. In some embodiments, left adjustable shoulder strap 310 and right adjustable shoulder strap 315 couple back panel 320 to left front panel 325 and right front panel 330, respectively, via one or more of a hook and eye fastener, a zipper, a hook and loop fastener, a snap closure, a magnetic closure, and one or more buttons. FIG. 3A shows right adjustable shoulder strap 315 coupling back panel 320 to right front panel 330 via a hook and loop fastener. The hook and loop fastener configuration is shown in more detail on portions of left adjustable shoulder strap 310.

FIG. 4 is a schematic showing the interior of the front portion of bra 300. Interior mesh lining 340 may form a left pocket 405 with the compressive material of left cup 335. Left pocket 405 may have an opening 410 proximate a lateral end of left cup 335. Interior mesh lining 340 may also form a right pocket 415 with the compressive material of right cup 345. Right pocket 415 may have an opening 420 proximate a lateral end of right cup 345. Openings 410, 420 may be sized and shaped to accommodate a surgical dressing, a padded insert, a cooling pack, or a prosthetic for the reasons described above with respect to openings 210, 220.

Interior mesh lining 340 may have a coating comprising an antibacterial, antimicrobial agent for reasons described above. In some embodiments, the antibacterial, antimicrobial agent may be triclosan. In some embodiments, body portion 305, left adjustable shoulder strap 310, and right adjustable shoulder strap 315 each comprise respective interior surfaces coated with the antibacterial, antimicrobial agent.

Figure 5:
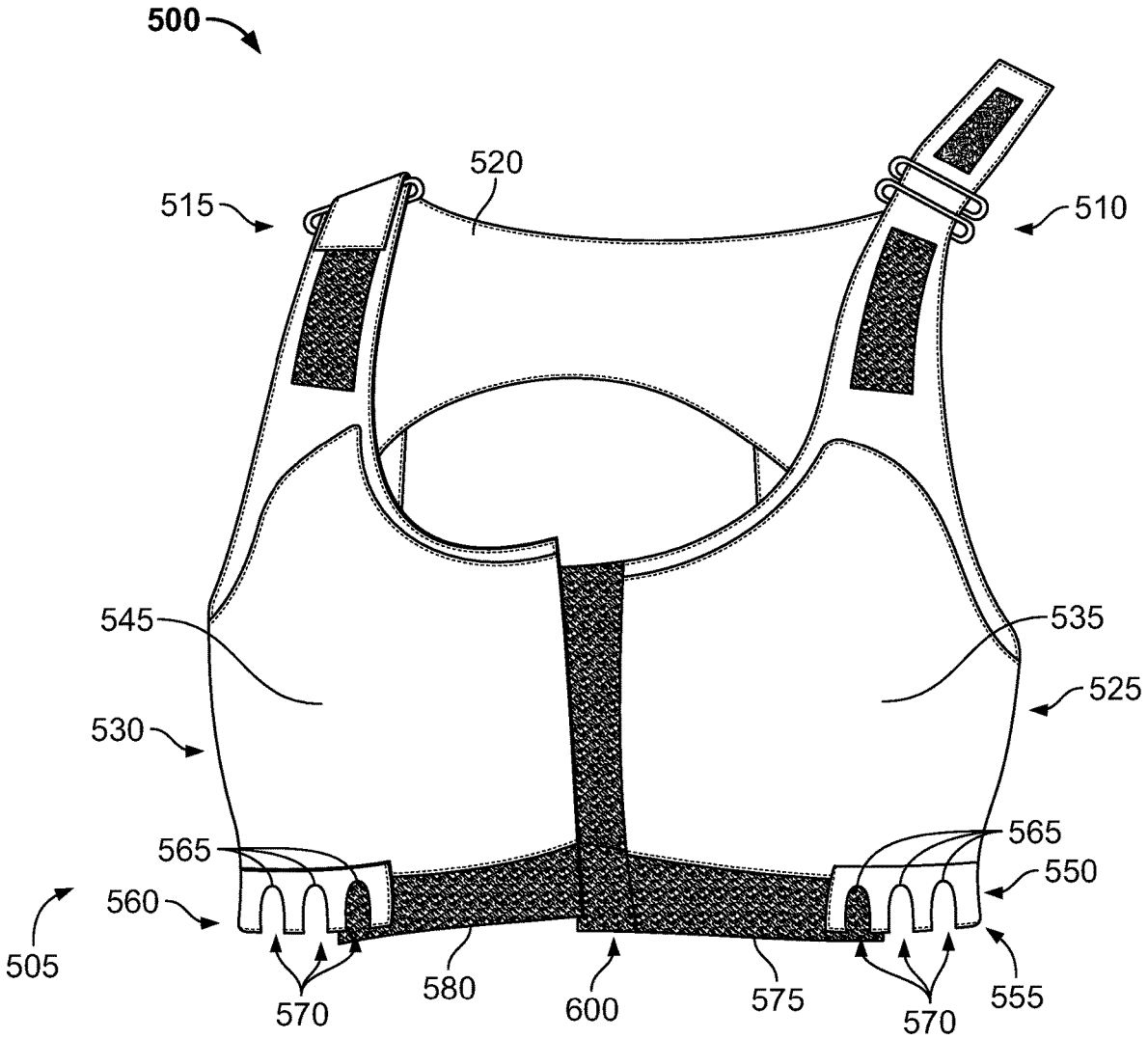
FIG. 5 is a schematic front view of a bra in accordance with some embodiments of the present disclosure.

FIG. 5 is a schematic front view of a bra 500 in accordance with some embodiments of the present disclosure. A rear view of bra 500 may be similar to that of bra 300, shown in FIG. 3B. Bra 500 comprises a body portion 505, as well as a left adjustable shoulder strap 510, and a right adjustable shoulder strap 515.

Body portion 505 comprises a back panel 520 similar to that of bra 300, illustrated in FIG. 3B. Body portion 505 further comprises a left front panel 525 and a right front panel 530 similar to those of bra 300, illustrated in FIG. 3A. Left front panel 525 comprises a left cup 535, which may have an interior mesh lining over at least a portion of the cup 535, similar to that of bra 300 shown in FIG. 4. Right front panel 530 comprises a right cup 545, which may also have an interior mesh lining over at least a portion of the cup 545, similar to that of bra 300 shown in FIG. 4.

Body portion 505 further comprises a torso strap 550 that extends around the circumference of the lower end of body portion 505. In some embodiments, torso strap 550 may be an elastic material. Torso strap 550 comprises a scalloped left strap portion 555 and a scalloped right strap portion 560. Scalloped left strap portion 555 comprises a left-side plurality of scalloped edges 565 and extends along at least a portion of the bottom of left front panel 525. Scalloped right strap portion 560 comprises a right-side plurality of scalloped edges 565 and extends along at least a portion of the bottom of right front panel 530. The left-side and right-side plurality of scalloped edges 565 form a left-side and right-side plurality of drainage ports 570, respectively, for the reasons described above with respect to drainage ports 370. In some embodiments, each drainage port 570 of the left-side and right-side plurality of drainage ports may have a height between 2 cm and 4 cm and a width between 2 cm and 4 cm. Similar to bra 300 (shown in FIGS. 3A and 3B), in some embodiments, scalloped left strap portion 555 may extend laterally from the center of left cup 535 to the center of back panel 520, and scalloped right strap portion 560 may extend laterally from the center of right cup 545 to the center of back panel 520.

Torso strap 550 may further comprise a medial left strap portion 575 that extends along at least a portion of the bottom of left front panel 525. Medial left strap portion 575 may be removably attachable to scalloped left strap portion 555 by a fastener, such as a hook and loop fastener, as illustrated in FIG. 5. This enables a user to adjust the circumference and cup size of bra 500, which allows bra 500 to accommodate patients with a variety of rib cage and cup sizes. Additionally, this enables a user to adjust the location of drainage ports 570 to accommodate varied drain placement. Torso strap 550 may further comprise a medial right strap portion 580 that extends along at least a portion of the bottom of right front panel 530. Medial right strap portion 580 may be removably attachable to scalloped right strap portion 560 by a fastener, such as a hook and loop fastener, as illustrated in FIG. 5. This enables a user to make the adjustments described above.

Body portion 505 further comprises a releasable front closure 600 similar to releasable front closure 400. Releasable front closure 600, left adjustable shoulder strap 510, and right adjustable shoulder strap 515 are similar to those of bra 300, illustrated in FIG. 3A and described above with respect to bra 300.

Although examples are illustrated and described herein, embodiments are nevertheless not limited to the details shown, since various modifications and structural changes may be made therein by those of ordinary skill within the scope and range of equivalents of the claims.

What is claimed is:

1. A bra comprising:

a body portion comprising:

a back panel;

a left front panel formed from a compressive material, said left front panel comprising a left cup having an interior mesh lining over at least a portion of said left cup, said mesh lining forming a pocket with the compressive material of the left cup, and said mesh lining having a coating comprising an antibacterial, antimicrobial agent; and a right front panel formed from a compressive material, said right front panel comprising a right cup having an interior mesh lining over at least a portion of said right cup, said mesh lining forming a pocket with the compressive material of the right cup, and said mesh lining having a coating comprising the antibacterial, antimicrobial agent;

an adjustable torso strap having at least portions formed from compressive material, said torso strap comprising:

a back torso strap extending along the bottom of said back panel;

a left front torso strap extending along the bottom of said left front panel, said left front torso strap including a hook/loop exterior surface extending laterally from proximate a medial end along at least a portion of said left front torso strap;

a right front torso strap extending along the bottom of said right front panel, said right front torso strap including a hook/loop exterior surface extending laterally from proximate a medial end along at least a portion of said right front torso strap;

a left side torso strap extending from said back torso strap, said left side torso strap having an end portion removably attachable to said left front torso strap via a loop/hook interior surface of the end portion, when attached to said left front torso strap, said left side torso strap and the bottom edge of said left front panel defining a left drainage port; and a right side torso strap extending from said back torso strap, said right side torso strap having an end portion removably attachable to said right front torso strap via a loop/hook interior surface of the end portion, when attached to said right front torso strap, said right side torso strap and the bottom edge of said right front panel defining a right drainage port;

and a releasable front closure configured to join said left and right front panels and said left and right front torso straps, a left adjustable shoulder strap extending from said back panel to said left front panel;

and a right adjustable shoulder strap extending from said back panel to said right front panel.

2. The bra of claim 1 wherein the pocket of the left cup has an opening proximate a lateral end of the left cup, and the pocket of the right cup has an opening proximate a lateral end of the right cup.

3. The bra of claim 2 wherein said respective openings are sized and shaped to accommodate a surgical dressing, a soft, padded insert, a cooling pack, or a prosthetic.

4. The bra of claim 1 wherein the antibacterial, antimicrobial agent is triclosan.

5. The bra of claim 1 wherein the releasable front closure is one or more of a hook and eye fastener, a zipper, a hook and loop fastener, a snap closure, a magnetic closure, and one or more buttons.

6. The bra of claim 1 wherein the left adjustable shoulder strap and the right adjustable shoulder strap couple the back panel to the left and right front panels, respectively, via one or more of a hook and eye fastener, a zipper, a hook and loop fastener, a snap closure, a magnetic closure, and one or more buttons.

7. The bra of claim 1 wherein the body portion, the right adjustable shoulder strap, and the left adjustable shoulder strap each comprise respective interior surfaces and said respective interior surfaces are coated with the antibacterial, antimicrobial agent.

8. The bra of claim 1 wherein the right drainage port has a height between 2 cm and 4 cm and a width between 2 cm and 4 cm, and wherein the left drainage port has a height between 2 cm and 4 cm and a width between 2 cm and 4 cm.

9. A bra comprising:

a body portion comprising:

a back panel;

a left front panel formed from a compressive material, said left front panel comprising a left cup having an interior mesh lining over at least a portion of said left cup, said mesh lining forming a pocket with the compressive material of the left cup, and said mesh lining having a coating comprising an antibacterial, antimicrobial agent; and a right front panel formed from a compressive material, said right front panel comprising a right cup having an interior mesh lining over at least a portion of said right cup, said mesh lining forming a pocket with the compressive material of the right cup, and said mesh lining having a coating comprising the antibacterial, antimicrobial agent;

a torso strap that extends around the circumference of the lower end of the body portion, the torso strap comprising:

a scalloped left strap portion comprising a left-side plurality of scalloped edges, said scalloped left strap portion extending along at least a portion of the bottom of the left front panel; and a scalloped right strap portion comprising a right-side plurality of scalloped edges, said scalloped right strap portion extending along at least a portion of the bottom of the right front panel;

wherein the left-side plurality of scalloped edges and the right-side plurality of scalloped edges form a left-side and right-side plurality of drainage ports, respectively;

a releasable front closure configured to join said left and right front panels;

a left adjustable shoulder strap extending from said back panel to said left front panel;

and a right adjustable shoulder strap extending from said back panel to said right front panel.

10. The bra of claim 9 wherein the pocket of the left cup has an opening proximate a lateral end of the left cup, and the pocket of the right cup has an opening proximate a lateral end of the right cup.

11. The bra of claim 10 wherein said respective openings are sized and shaped to accommodate a surgical dressing, a soft, padded insert, a cooling pack, or a prosthetic.

12. The bra of claim 9 wherein the antibacterial, antimicrobial agent is triclosan.

13. The bra of claim 9 wherein the releasable front closure is one or more of a hook and eye fastener, a zipper, a hook and loop fastener, a snap closure, a magnetic closure, and one or more buttons.

14. The bra of claim 9 wherein the left adjustable shoulder strap and the right adjustable shoulder strap couple the back panel to the left and right front panels, respectively, via one or more of a hook and eye fastener, a zipper, a hook and loop fastener, a snap closure, a magnetic closure, and one or more buttons.

15. The bra of claim 9 wherein the torso strap is an elastic material.

16. The bra of claim 9 wherein each drainage port of the left-side and right-side plurality of drainage ports has a height between 2 cm and 4 cm and a width between 2 cm and 4 cm.

17. The bra of claim 9 wherein the scalloped left strap portion extends laterally from the center of the left cup to the center of the back panel, and wherein the scalloped right strap portion extends laterally from the center of the right cup to the center of the back panel.

18. The bra of claim 9 wherein the body portion, the left adjustable shoulder strap, and the right adjustable shoulder strap each comprise respective interior surfaces and said respective interior surfaces are coated with the antibacterial, antimicrobial agent.

19. The bra of claim 9 wherein the torso strap further comprises:

a medial left strap portion that extends along at least a portion of the bottom of the left front panel, said medial left strap portion being removably attachable to said scalloped left strap portion; and a medial right strap portion that extends along at least a portion of the bottom of the right front panel, said medial right strap portion being removably attachable to said scalloped right strap portion.

20. The bra of claim 19 wherein the medial left strap portion and the scalloped left strap portion are removably attachable to one another by a first hook and loop fastener, and wherein the medial right strap portion and the scalloped right strap portion are removably attachable to one another by a second hook and loop fastener.

* * * * *